US005394316A

United States Patent [19]

Holbrook et al.

[11] Patent Number: 5,394,316

[45] Date of Patent: Feb. 28, 1995

[54] LOCKING LAMP ASSEMBLY FOR EXAMINATION LIGHT

[75] Inventors: Marcia J. Holbrook; Robb D. Bonilla, both of Auburn; Robert G. Tiller, Syracuse, all of N.Y.

[73] Assignee: Welch Allyn, Inc., Skaneateles Falls, N.Y.

[21] Appl. No.: 44,801

[22] Filed: Apr. 12, 1993

[51] Int. Cl.[6] ..... F21V 17/00

[52] U.S. Cl. ..... 362/294; 362/345; 362/375; 362/374; 362/414; 362/285

[58] Field of Search ..... 362/374, 375, 429, 410, 362/431, 414, 310, 226, 285, 345, 294, 804

[56] References Cited

U.S. PATENT DOCUMENTS

| | | | |
|---|---|---|---|
| 1,298,770 | 4/1919 | Mould | 362/429 |
| 1,678,137 | 7/1928 | Douglas | 362/375 |
| 1,844,651 | 2/1932 | Halvorson . | |
| 2,096,270 | 10/1937 | Worden | 362/375 |
| 2,852,758 | 9/1958 | Beaubien et al. | 362/374 X |
| 3,375,366 | 3/1968 | Scheppe | 362/294 |
| 3,651,321 | 3/1972 | Magi et al. | 362/455 |
| 4,135,231 | 1/1979 | Fisher | 362/297 X |
| 4,460,947 | 7/1984 | Kelly | 362/374 |
| 4,654,768 | 3/1987 | Dryman et al. | 362/374 |
| 4,764,854 | 8/1988 | Matsune et al. | 362/226 X |

FOREIGN PATENT DOCUMENTS 843 of 1914 United Kingdom ..... 362/375

*Primary Examiner*—Ira S. Lazarus
*Assistant Examiner*—Thomas M. Sember
*Attorney, Agent, or Firm*—Harris Beach & Wilcox

[57] ABSTRACT

A lamp assembly for an examination light has a housing and reflector with a cover that assembles into the housing. The cover has four groups of three lugs each which upon rotation of approximately forty-five degrees engage in corresponding recesses in the housing. The recesses have a ramp latch at the entrance and a stop at the exit so that the lugs can be resiliently introduced into the recesses. Once in place the lugs are locked therein and prevent unauthorized disassembly. The inherent resilience of the plastic molded housing and cover allow the necessary camming action of the ramp latch without destroying either part. Once assembled, the ramp latch and stop prevent further rotation and removal of the cover from the housing except by use of special tools. The top of the housing is provided with a hinged cap that allows a lamp and socket to be displaced from within the interior of the otherwise sealed and locked assembly.

11 Claims, 5 Drawing Sheets

LOCKING LAMP ASSEMBLY FOR EXAMINATION LIGHT

BACKGROUND OF THE INVENTION

1. Field of the Invention

This invention relates generally to examination lights, and more particularly to an improved lamp assembly for an examination light including a lamp housing and a cover portion that can be easily assembled and locked together to prevent unauthorized disassembly.

2. Discussion of the Prior Art

In modern high voltage and/or high temperature and pressure lamps, it is increasingly desirable that a lamp assembly containing such a lamp be capable of providing adequate safety features. Typical metal halide or halogen lamps that are used in examination lights operate at significantly higher temperatures and pressures than conventional incandescent lamps. These high temperature lamps pose a significant safety threat to persons having accidental contact with the heated lamp or otherwise improperly servicing the examination light. Prior art lamp assemblies have not kept pace with the increased safety requirements associated with these high temperature and pressure lamps.

OBJECTS AND SUMMARY OF THE INVENTION

Accordingly, it is an object of the present invention to provide a lamp assembly for use in an examination light that overcomes the limitations of the prior art.

It is another object of the present invention to provide a lamp assembly having a lamp housing portion, a reflector portion, and a cover portion which when fully assembled, are locked together so they cannot be taken apart by unauthorized persons without causing damage to the lamp housing or the cover portion of the lamp assembly.

It is another object of the present invention to provide a lamp housing with a series of internal vertical ribs which support a reflector for a lamp provided therein.

It is a further object of the present invention to provide a reflector with rectangular vent holes and clamping tabs that is secured against the end portions of internal vertical ribs of a lamp housing by a locked cover.

It is still yet another object of the present invention to provide a cover for a lamp housing and reflector which is circular in shape and which can be rotated into locked condition to secure the reflector and lock the cover onto the housing.

Yet a further object of the present invention is to provide a cover with a series of radially disposed lugs mounted on flexible posts that lockingly engage in corresponding recesses in a lamp housing by rotation of one relative to the other.

It is a further object of the present invention to provide a lamp housing with a ramp and a stop arranged to cooperatively engage a series of radially extended lugs on a cover to securely hold the cover in place in the lamp housing and at the same time clamp a reflector in place within the assembly.

Still another object of the present invention is to provide a lamp housing with a one-way latching mechanism for allowing a cover to be rotated into locking engagement into the lamp housing to prevent disassembly without damage thereto.

An additional object of the present invention is to provide a hinged cap for the top portion of an otherwise sealed and locked lamp assembly that flips open and closed having secured thereon a socket for a lamp such that the lamp can be removed from within the interior of the lamp assembly by flipping open the hinged cap.

These and other and further objects are attained in one embodiment by the provision of an inwardly directed lip and a series of vertical ribs on a circular lamp housing, a generally conically shaped reflector with corresponding tabs and outwardly directed multiple lug "segments mounted on the circumference of a cover by flexible posts. The lug segments are sized to fit in corresponding annular recesses formed in the lamp housing and apertures are provided in the lamp housing to permit access to the recesses. A ramp latch is provided at the entrance to the annular recess region and a stop is provided so that once the cover is snapped into the cooperating recesses, it is secured to the lamp housing and cannot be removed without damage to either the cover or the lamp housing. The top portion of the lamp housing is provided with a hinged cap that has securely fixed to the interior side thereof a socket for a metal halide or halogen lamp. The hinged cap remains closed during operation of the examination light and in this closed position properly places the lamp and lamp socket centrally above the cover. When the hinged cap is flipped open, the lamp and lamp socket are thereby displaced from the interior of the otherwise sealed and locked lamp assembly.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE PREFERRED EMBODIMENT

Figure 1:
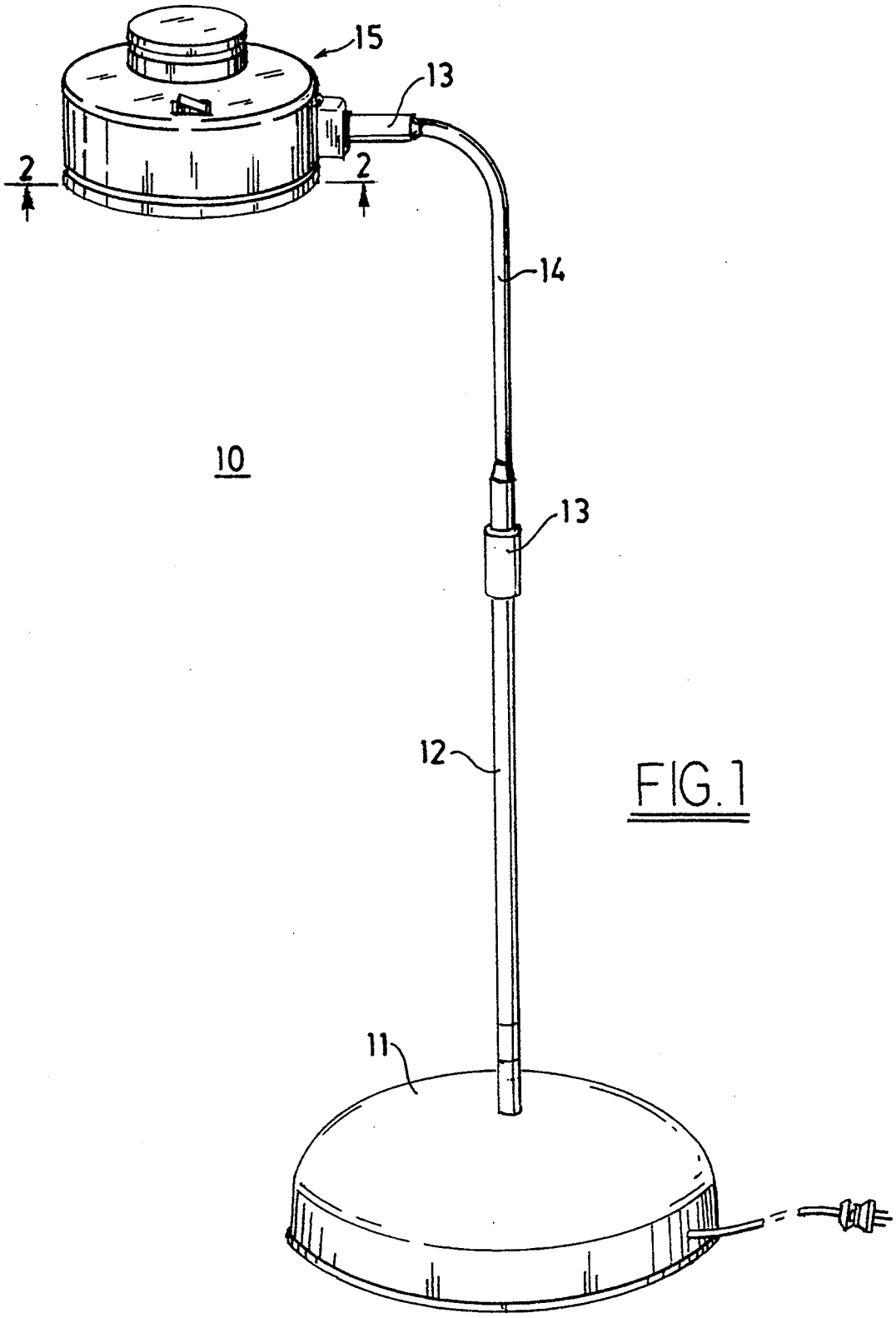
FIG. 1 is a perspective view of an examination light embodying the lamp assembly of the present invention.

Referring now to FIG. 1, there is shown an examination light 10 which is comprised of a base 11, a base pole 12, a pair of connectors 13, a gooseneck 14, and a lamp assembly 15 according to the present invention, mounted at the upper end of gooseneck member 14.

Figure 2:
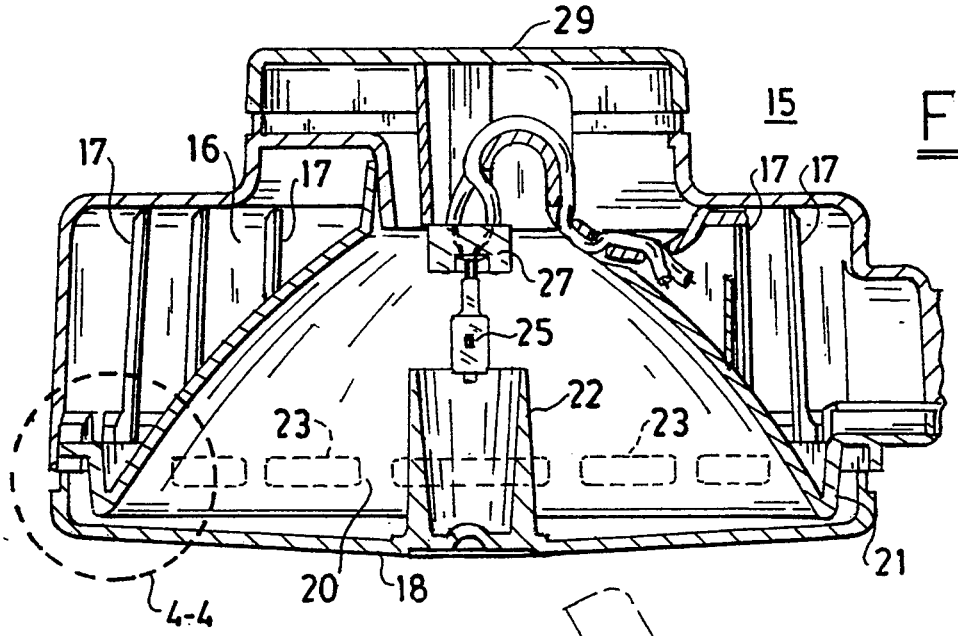
FIG. 2 is a cross sectional view of the lamp assembly according to the present invention taken along line 2—2 of FIG. 1.
Figure 3:
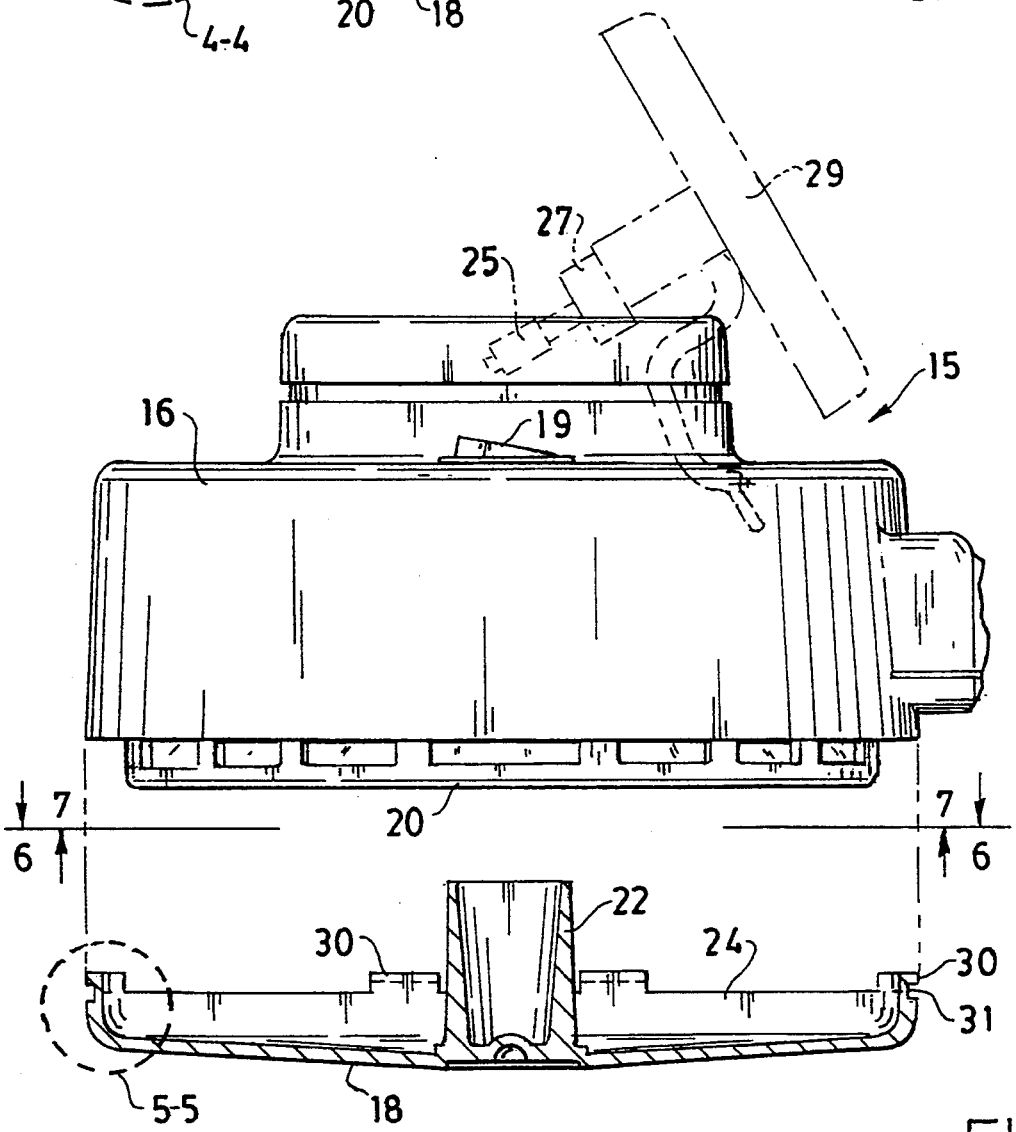
FIG. 3 is a side elevational view of the lamp assembly according to the present invention showing the cover disassembled therefrom and the hinged cap in phantom in the open position.

As may be seen in FIGS. 2 and 3, lamp assembly 15 of the present invention is comprised of a lamp housing 16 with a plurality of internal vertical ribs 17—17 and a light transmitting cover 18 positioned in the open side of lamp housing 16. Mounted within lamp housing 16 in cooperative alignment with cover 18 is a frustoconical reflector 20 with a flange or return portion 21. Positioned on the periphery of flange 21 is a plurality of rectangular vent holes 23—23. A lamp 25 is mounted at the apex of reflector 20 in a socket 27 which in turn is secured to the internal face of a hinged cap 29. Hinged cap 29 is shown in the closed position in FIG. 2 and in the open position in phantom in FIG. 3. The hinged cap 29 allows the lamp 25 to be removed from within the interior of lamp housing 16 for cooling and inspection without a person having to directly touch the potentially hot lamp 25. An on/off switch 19 for lamp 25 is provided on the top of housing 16. Lamp housing 16, cover 18 and the lower opening of the reflector 20 are circular in configuration. Cover 18 has a central cup member 22 mounted at the center thereof that extends upwardly to surround the tip of lamp 25 mounted within lamp housing 16. Cover 18 is generally dish shaped with an upwardly extending rim portion 24 which has formed about the circumference thereof groups of outwardly extending lugs 30—30, each of the lugs being mounted on a flexible extension or post 31, as will be described in more detail hereinafter. Each group contains three circumferentially spaced lugs as shown in the drawings.

FIGS. 4 and 8–10 show that lamp housing 16 has formed around its lower periphery a plurality of inwardly directed ridge or lip portions 26—26 which form the bottom portion of a plurality of recesses 28—28 in which lugs 30 are positioned when lamp housing 16, reflector 20 and cover 18 are assembled. Ridge portions 26—26 alternate circumferentially with a plurality of apertures 32—32.

Figure 5:
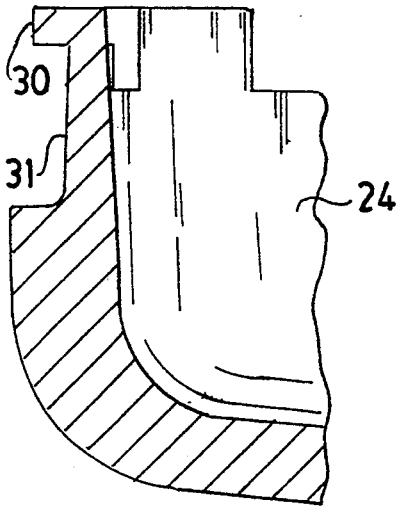
FIG. 5 is a view of the detail 5—5 of FIG. 3.
Figure 4:
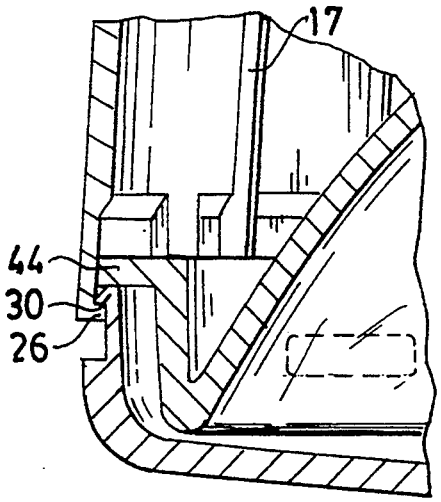
FIG. 4 is a view of the fragmentary cross-section of the detail 4—4 in FIG. 2.
Figure 6:
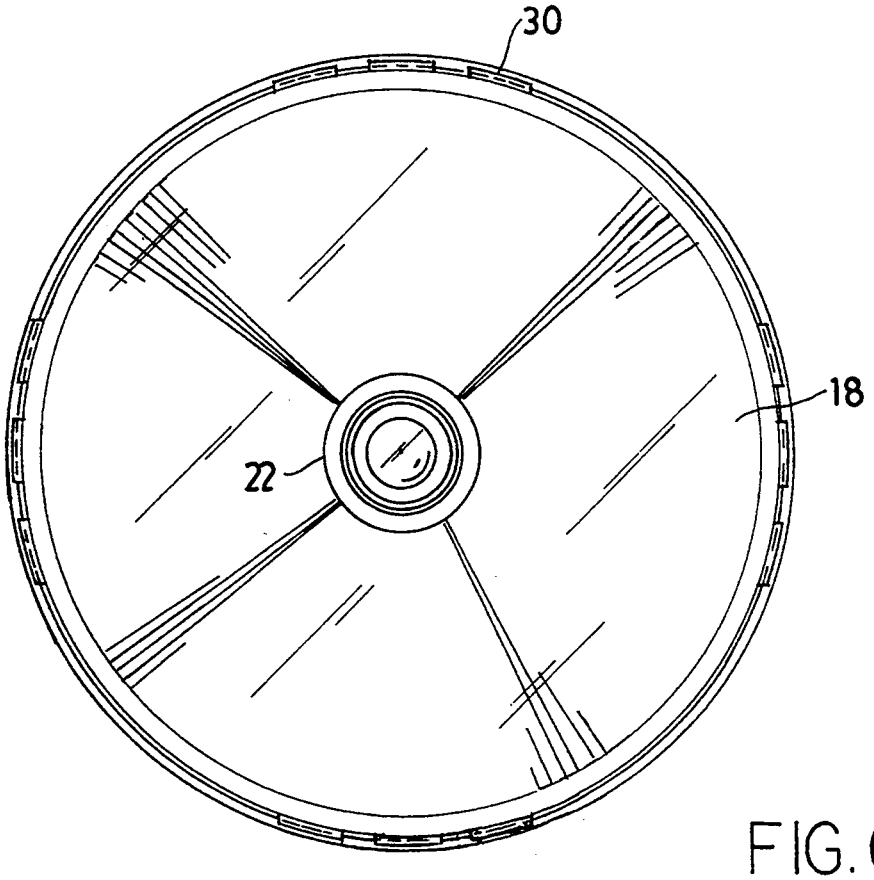
FIG. 6 is a view taken on line 6—6 of FIG. 3.
Figure 7:
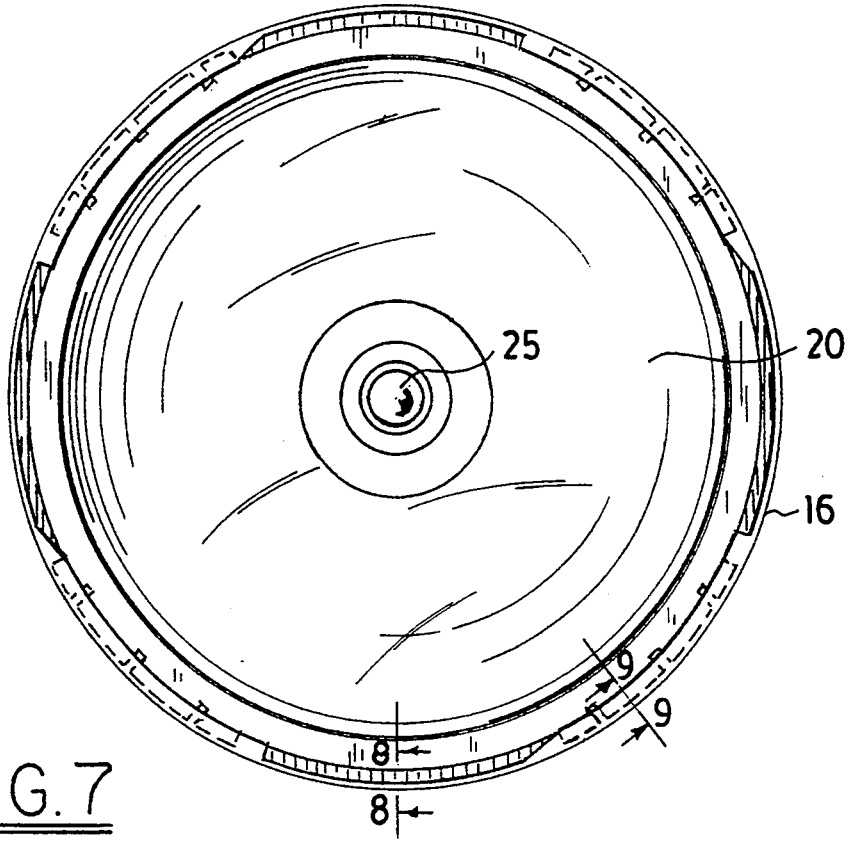
FIG. 7 is a view taken on line 7—7 of FIG. 3.
Figure 8:
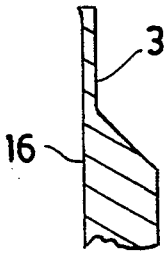
FIG. 8 is a partial sectional view taken on line 8—8 of FIG. 7.
Figure 9:
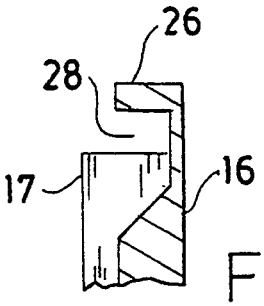
FIG. 9 is a partial sectional view taken on line 9—9 of FIG. 7.
Figure 10:
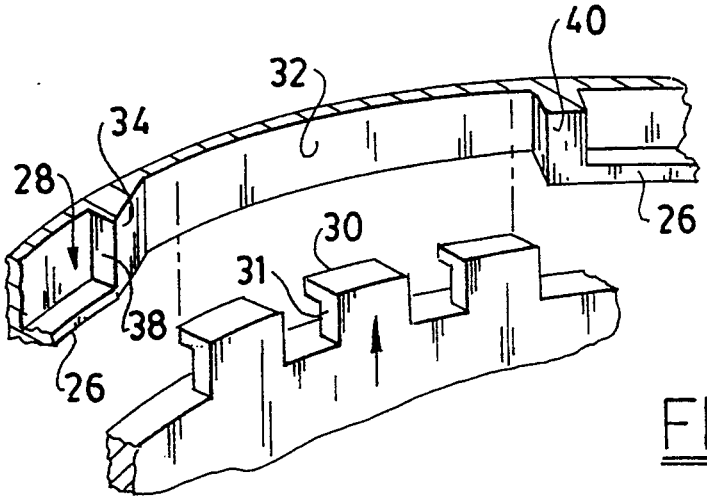
FIG. 10 is a partial exploded perspective view of a lug segment and interlocking recess entrance.
Figure 11:
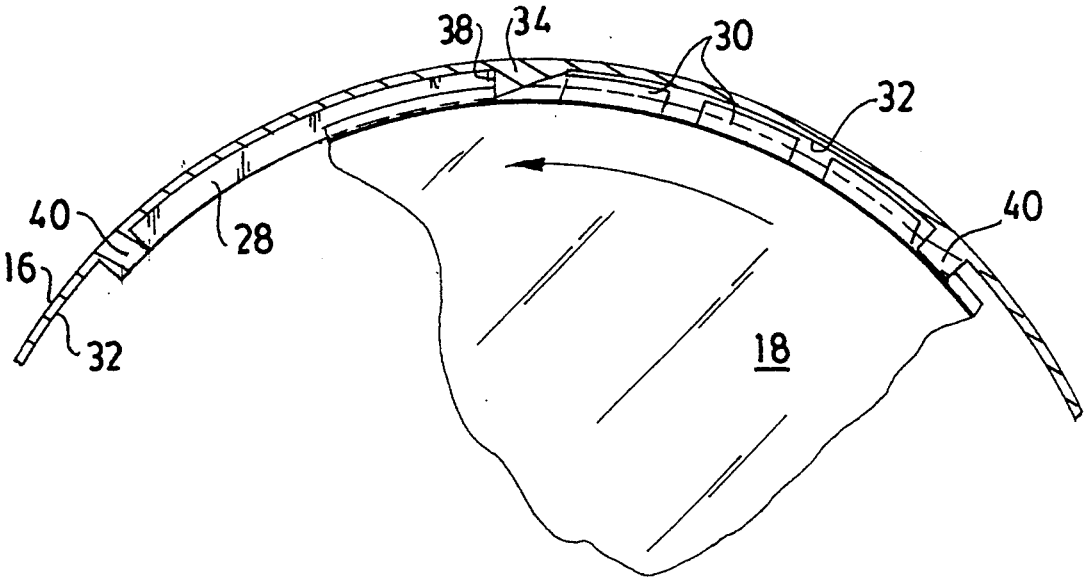
FIG. 11 is a plan view partially broken away of the cover assembled with the lamp housing preparatory to rotation into interlocking position within the recess.
Figure 12:
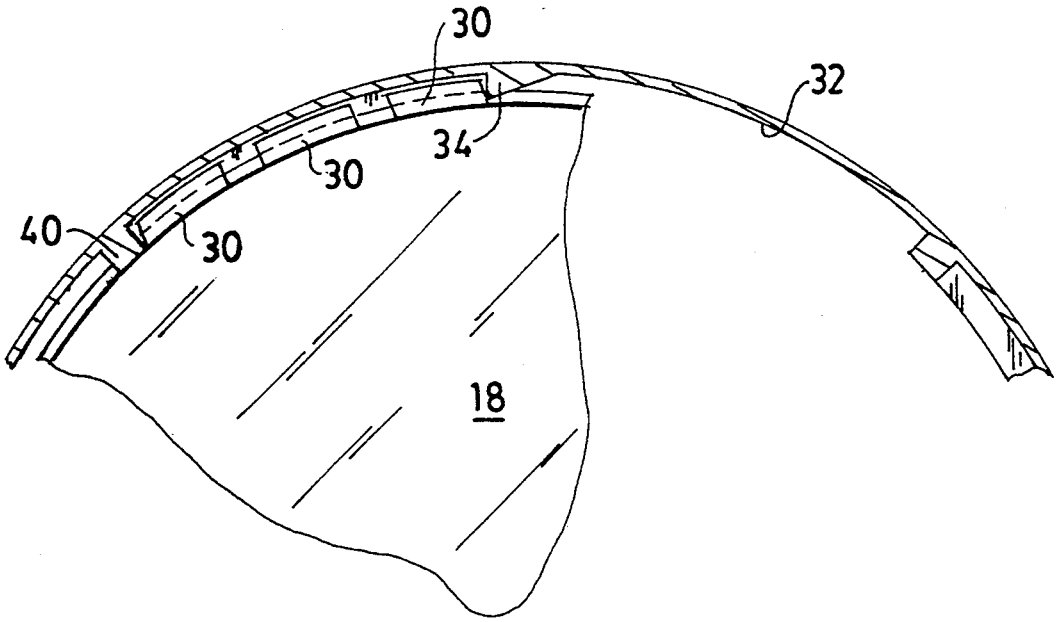
FIG. 12 is a view similar to FIG. 11 showing the cover in the rotated interlocked position with the lamp housing.

In the preferred embodiment of the present invention, as shown in FIGS. 5–7, lugs 30 are grouped in four groups of three lugs each and extend outwardly in a radial fashion from the circumference of rim 24 of circular cover 18. Individual lugs 30 and supporting posts 31 are spaced apart a short distance so that each group of lugs will fit within one of the apertures 32 of lamp housing 16 prior to rotation and locking. As shown in FIGS. 10, 11 and 12, four equally spaced groups of three lugs 30 are formed on cover 18 and four corresponding apertures 32 are formed in lamp housing 16 to allow cover 18 to be assembled with lamp housing 16 by rotating lugs 30 into recesses 28. Recesses 28 are formed in groups at spaced intervals of ninety degrees about the circumference of lamp housing 16 and are sized to receive therein three adjacent lugs 30.

As shown in FIG. 10, at the entrance to each recess 28 there is positioned a ramp latch 34 formed on the lower inner circumference of lamp housing 16. Ramp latch 34 has a latch face 38 that projects radially inward. At the other end of each recess 28 a stop 40 is formed to prevent continued rotation of lugs 30 within recesses 28. As may be seen in FIG. 11, lugs 30, as cover 18 is rotated, engage ramp latch 34 causing lamp housing 16 to be slightly flexed outwardly and posts 31 to be slightly deflected inwardly so that lugs 30 can pass over ramp latch 34 into recess 28. This action is repeated at the second and third lugs until all three lugs are secured in recesses 28 at every ninety degrees around the inner circumference of lamp housing 16. FIGS. 11 and 12 show that as lugs 30 pass over ramp latch 34 and drop into recess 28, lamp housing 16 will spring back into its original configuration so that latch face 38 of ramp latch 34 will retain the trailing edge of the last lug 30 and prevent reverse rotation out of recesses 28. Stop 40 will retain the leading edge of the first lug 30 and prevent continued forward rotation. The fully engaged and locked position is shown in FIG. 12. In this configuration, cover 18 cannot be removed from lamp housing 16 without in some way damaging either the housing or the cover unless a special tool is employed. As may be seen in further detail in FIGS. 5 and 10, lugs 30, but not posts 31, provide supporting contact with lamp housing 16. While in contact with lamp housing 16, lugs 30 slide when rotated over ramp latch 34 then after completing rotation come to rest in recesses 28 to securely hold cover 18 and reflector 20 to lamp housing 16.

Referring again to FIGS. 2 and 4, reflector 20 has flange portion 21 about the outer circumference thereof. On the upper edge of flange 21 is a series of outwardly directed tabs 44. The preferred embodiment of the present invention has eight tabs 44 that correspond in arc length to the arc length of recesses 28 and apertures 32. The diameter of reflector 20 taken from the edge of tabs 44 is chosen to match the diameter of cover 18 taken from the edge of outwardly extending lugs 30 so that both will fit within the same recesses 28 and apertures 32 of lamp housing 16. Tabs 44 of reflector 20 have an arc length approximately equal to the arc length covered by three spaced apart lugs 30 and, as mentioned above, approximately equal to the arc length of recesses 28. Reflector 20 is secured to lamp housing 16 by four of the tabs 44 which rest against the end portions of ribs 17 provided within recesses 28. The other four tabs 44 are positioned within apertures 32 and provide lateral support to lamp housing 16. As cover 18 is rotated into place, lugs 30 securely clamp tabs 44 against the end portions of ribs 17 of lamp housing 16. Lamp assembly 15 then, includes lamp housing 16, hinged cap 29, cover 18 and reflector 20 positioned so that four outwardly extending tabs 44 are in recesses 28 supported by the end portions of ribs 17. Lugs 30 of cover 18 are inserted into apertures 32 as shown in FIGS. 10 and 11 and rotated into recesses 28 thereby locking reflector 20, lamp housing 16, and cover 18 together into an integral assembly that cannot be taken apart without damaging either lamp housing 16 or cover 18 in some fashion.

This locking feature makes it extremely difficult for personnel and inexperienced service persons to in any way come in accidental contact with the potentially hot lamp 25. This locking feature also ensures that a lamp assembly according to the present invention will not accidentally fall apart in use thereby causing injury to an individual being examined. In addition, since the cover 18 cannot be easily removed, the reflector 20 will be kept dustfree and clean thereby maintaining the optical quality of the spot.

To provide the required amount of elastic deformation needed for assembly, lamp housing 16 and cover 18, including central cup member 22, lugs 30, and posts 31 are made of resilient plastic materials such as ABS, polycarbonate or other plastics suitable for use as housings and transparent covers. The three lugs in the four groups, even though having a relatively narrow radial dimension, provide in aggregate sufficient surface support to fully and completely hold cover 18 within lamp housing 16. If, for instance, a single lug 30 were used, it would have to have a much greater radial dimension, and possibly longer circumferential dimension to provide the necessary support to secure cover 18 within lamp housing 16. While this could be done, it would also impose additional stress on the housing and on the cover when one was rotated relative to the other to position the lug within the recess to lock them together. Thus, the multiple lugs spaced about the circumference of the cover perform a superior engagement of the cover to the lamp housing and permit easy assembly without damage to either of the housing assembly members.

Cover 18 is made of a generally light transmitting material which may have reinforcing radial ripples or ribs therein. Such ripples or ribs would also serve to defuse light thereby smoothing out shadows and hot spots. Traditionally, lamps in a socket in a frustoconical reflector are end mounted so that the connections can be readily made through a minimum size aperture in the reflector. This frequently results in a "hot spot" of intense light at the end of a lamp, which can be very undesirable in various applications of an examination light. Central cup member 22 thus serves to diffuse and "blend-in" the light radiation from the end of lamp 25 with the balance of the radiation reflected from reflector 20. Central cup member 22 and rim 24 of cover 18 may also have an embossed diffuser surface on the inside thereof to further defuse and soften the light emitted directly out of the end of lamp 25.

There is thus shown a very secure, yet simple and economical way to manufacture a locking lamp assembly having a lamp housing, a reflector and a cover forming a highly efficient and safe light source for examination purposes.

While this invention has been explained with reference to the structure disclosed herein, it is not confined to the details set forth and this application is intended to cover any modifications and changes as may come within the scope of the following claims:

What is claimed is:

1. A lamp assembly comprising:

housing means for receiving a lamp and lamp socket therein, the housing means being open on one side;

means for supporting the lamp and lamp socket;

cover means for closing the open side of the housing means;

reflecting means for directing light from said housing means through said cover means, said reflecting means including a light reflecting member having an upper and a lower opening, said upper opening for receiving the lamp and lamp socket, and a flange portion formed at said lower opening;

locking means including a plurality of lugs and posts, each lug mounted on the distal end of a corresponding post, said posts being spaced at intervals about the edge of said cover means;

capture means being positioned proximate the open side of said housing means for receiving and retaining said lugs;

ramp means formed on said housing means over which said lugs pass as said housing means and said cover means move relative to each other at assembly, the relative movement causing said housing means and said posts to deflect slightly to allow said lugs to enter said capture means;

stop means for preventing escape of said lugs from said capture means after assembly; and a plurality of rib members formed in said housing means, said rib members having end portions which terminate within said capture means.

2. The lamp assembly according to claim 1 further including a plurality of vent holes formed in the flange portion.

3. The assembly according to claim 2 wherein said light reflecting member includes a plurality of tabs formed on an edge of said flange portion extending outwardly therefrom, whereby said tabs are clamped against the end portions of said rib members by said lugs as said lugs enter said capture means.

4. The lamp assembly according to claim 1 wherein said cover means includes a rim with a shoulder sized to fit into the open side of said housing means and said posts extend upwardly from said shoulder.

5. The lamp assembly according to claim 4 wherein said housing means has a plurality of apertures formed in cooperation with said capture means to allow said lugs to be positioned therein preparatory to subsequent displacement of said lugs into said capture means.

6. The lamp assembly according to claim 3 wherein said housing means, the lower opening of said light reflecting member and said cover means are circular.

7. The lamp assembly according to claim 1 wherein said plurality of lugs comprise at least two lugs disposed on an edge of said cover means.

8. The lamp assembly according to claim 1 wherein said means for supporting the lamp and lamp socket include a cap member hingedly connected to said housing means whereby when said cap member is in a closed condition, the lamp and lamp socket are positioned within said housing means above the center of said cover means and when said cap member is moved to an open condition, the lamp and lamp socket are thereby displaced from within said housing means so that the lamp can be removed from the socket.

9. The lamp assembly according to claim 6 wherein said plurality of lugs comprise four groups of three lugs each disposed about the circumference of said cover means at ninety degree intervals;

said plurality of tabs include at least four tabs formed at ninety degree intervals about the edge of said flange portion; and said capture means is comprised of four recesses formed at ninety degree intervals about the inside circumference of said housing means, each recess sized to receive therein a group of three lugs and one of said tabs of said light reflecting member.

10. The lamp assembly according to claim 9 wherein said ramp means is formed at an entrance end of each of the four recesses, and said stop means is formed at the other end of the four recesses.

11. The lamp assembly according to claim 10 wherein said stop means comprises a block segment and said ramp means comprises:

a wedge shaped block having a face portion and a ramp portion positioned along the lower inner circumference of said housing means between one end of said apertures and the entrance end of said recesses;

whereby said face portion and said block segment prevent escape of said lugs from said recesses after assembly of said cover means and said housing means by displacement of said lugs into said recesses.

* * * * *